United States Patent [19]

Owens

[11] Patent Number: 4,611,953

[45] Date of Patent: Sep. 16, 1986

[54] TLP TENDON BOTTOM CONNECTOR

[75] Inventor: Henry S. Owens, Santa Barbara, Calif.

[73] Assignee: Vetco Offshore Industries, Inc., Ventura, Calif.

[21] Appl. No.: 793,503

[22] Filed: Nov. 1, 1985

[51] Int. Cl.[4] ..... E02D 5/74; F16B 1/04

[52] U.S. Cl. ..... 405/224; 405/195; 405/169; 114/294; 114/338

[58] Field of Search ..... 405/224, 195, 169, 170, 405/171; 166/338, 340, 347, 349, 345, 351, 341, 348, 344; 114/293, 294, 295, 296, 297

[56] References Cited

U.S. PATENT DOCUMENTS

| | | | |
|---|---|---|---|
| 3,841,665 | 10/1974 | Capot | 166/340 X |
| 4,359,960 | 11/1982 | Burchett et al. | 114/294 |
| 4,374,630 | 2/1983 | Fraser, Jr. | 405/224 |
| 4,432,670 | 2/1984 | Lawson | 405/224 |
| 4,459,933 | 7/1984 | Burchett et al. | 405/224 X |

FOREIGN PATENT DOCUMENTS

| | | | |
|---|---|---|---|
| 2087330 | 5/1982 | United Kingdom . | |
| 765102 | 9/1980 | U.S.S.R. | 114/294 |

*Primary Examiner*—Dennis L. Taylor
*Attorney, Agent, or Firm*—Joseph R. Dwyer

[57] ABSTRACT

A bottom anchor connector for securing the tension legs of a tension leg platform (10) having a flexible joint (26) between a first body member (22) and a second body member (24) including a latch carrier (44) having latch segments (46) thereon which react with an anchor receptacle recess (18) to provide the connection between the connector (10) and the anchor receptacle (R) when the bottom connector (10) is lowered into the anchor receptacle (R). The latch carrier forms part of a self-actuating installation and release mechanism and includes, in one embodiment, keys (46) which cooperate with the receptacle recess (18) to position the dogheads (50) of the latch segments (46) to be free of the receptacle recess (18) so that the dogheads may move within the inner wall of the receptacle without reacting to the recess (18) to release the bottom connector from the receptacle. This is the primary release mechanism for disconnecting the bottom connector (10) from the receptacle (R) and is done without the use of tools, ROV intervention, or the like.

Two types of bottom connectors are disclosed, one, a non-rotatable type and, two, a rotatable type—both having similar primary release mechanisms.

There is also disclosed a redundant (secondary) means (tool 100) for releasing both types of bottom connectors (10) from the anchor receptacle (R).

23 Claims, 19 Drawing Figures

TLP TENDON BOTTOM CONNECTOR

BACKGROUND OF THE INVENTION

1. Field of Invention

This invention relates to tension leg platforms (TLP) and, in particular, to releasable connectors for securing the strings of tendon segments to anchor templates located at the seabed.

2. Prior Art

FIG. 1 herein, the U.S. Pat. Nos. 4,391,554 to Jones, and 4,439,055 to Quigg, et al.

FIG. 1 illustrates a tension leg platform outer column (jacket) C, typically located at each corner of a platform, with tendons T maintained continuously in tension, using platform buoyancy, with an anchor template AT at the seabed. The anchor template AT is secured to driven and/or drilled and cemented piles P. Although only one string or leg of tendon segments, coupled together, is shown, several such strings may run from various anchor templates to the platform, for the purpose of mooring the TLP to the seafloor.

The lower connection of the string of tendon segments is made by a latch and flex joint bottom or anchor connector AC, guided into the template receptacle R by a guide cone GC during installation, and latched to the template receptacle. Bending moment, caused by lateral motions of the TLP, is reduced by the flexible joint of the bottom connector AC. Such a lower anchor connector is shown in the Quigg, et al, patent, supra.

At the upper end of the string of tendon segments, there is provided a top connector for connection to the outer column C, not shown.

As shown in FIG. 1, the tension leg platform tendon system may extend through a hawsepipe HP and above the water level WL so that the bore of the tendon segments is accessible above the water. This type of TLP typically would include a bearing B at the lower end of the hawsepipe, to react lateral loads and motions into the tendon. Such a bearing is described in the Jones patent, supra, also having a flexible joint arrangement to minimize bending loads into the tendon. Such a tension leg platform tendon system has the advantage, among other things, of allowing tools to be conveniently lowered through the tendon segment bores by which the tendons can be inspected, and by which the lower connector may be disconnected from the anchor template AT so that the platform may be moved, when and if desired. Such a tool for disconnecting the bottom connector is shown in the Quigg, et al, patent, supra.

Another type of tendon system for connecting a tension leg platform is one which is suspended from outside the tension leg platform and below the waterline, rather than run through hawsepipes as above described, shown in FIG. 2. With this type of tendon system the release mechanism for disconnecting the bottom connector of the above described system may be used, but access to the tendon bore may be inconvenient, making an anchor connector which is releasable from outside the tendon desirable. Also, sometimes the inner bore of the tendons may become clogged with debris, or perhaps it might be desirable to have baffles within the tendons, making internal access impossible.

In each of the above cases, a primary release mechanism that is self-actuating, i.e., operable without the use of tools, without the use of a remote operable vehicle (ROV) and/or a release mechanism that is operable by a tool outside the tendons would obviously be preferred.

It is, therefore, an object of this invention to provide such a self-connecting bottom connector with a self-actuating release mechanism as a primary means of disconnecting the bottom connector, i.e., one which is releasable without the use of tools, without a remotely operable vehicle (ROV) intervention or any other external intervention.

It is also an object of this invention to provide a self-connecting bottom tendon connector for connecting the tendons of a tension leg platform which may be conveniently connected and disconnected without tools insertable through the inner bore of the tendons.

It is still another object of this invention to provide such a self-connecting bottom connector with a releasable means which is fail-safe and which can provide long life and minimize installation and removal requirements.

Still another object of the invention is to provide such a bottom connector with a redundant means for releasing the bottom connector, if desired, in the event the primary means of disconnecting the bottom connector is not used for whatever reason.

SUMMARY OF THE INVENTION

A bottom anchor connector having a flexible joint for securing the tension legs of a tension leg platform, and including a latch carrier having latch segments (dogs and dogheads) thereon which react with an anchor receptacle recess to provide the connection between the connector and the anchor receptacle when the bottom connector is lowered into the anchor receptacle. The flexible joint allows bending movement between a first body member in engagement with the inner wall of the receptacle via the latch segments and a second body member connected to the tension leg segments. The latch carrier forms part of the self-actuating connection and release mechanism and includes, in one embodiment, keys which cooperate with the receptacle recess to position the dogheads upon movement of the latch carrier with respect to the first body member so that the dogheads may move within the inner wall of the receptacle without reacting to the recess to release the bottom connector from the receptacle. This is the primary release mechanism for disconnecting the bottom connector from the receptacle and is done without the use of running tools, ROV intervention, or the like.

Two types of self-connecting bottom connectors are disclosed—a non-rotatable and a rotatable type—both having similar primary release mechanisms.

There is also provided a redundant release means—a hydraulically actuated tool which will cause relative movement between the latch carrier and the first member to free the doghead of reaction to the receptacle recess in the event that the primary release mechanism is not used.

DETAILED DESCRIPTION

In this description, "tension leg", "tendons", and "string of tendon segments" are used interchangeably; as are "anchor" or "bottom" connector and "latch"; and "anchor template" "receptacle" and "anchor pile."

Figure 1:
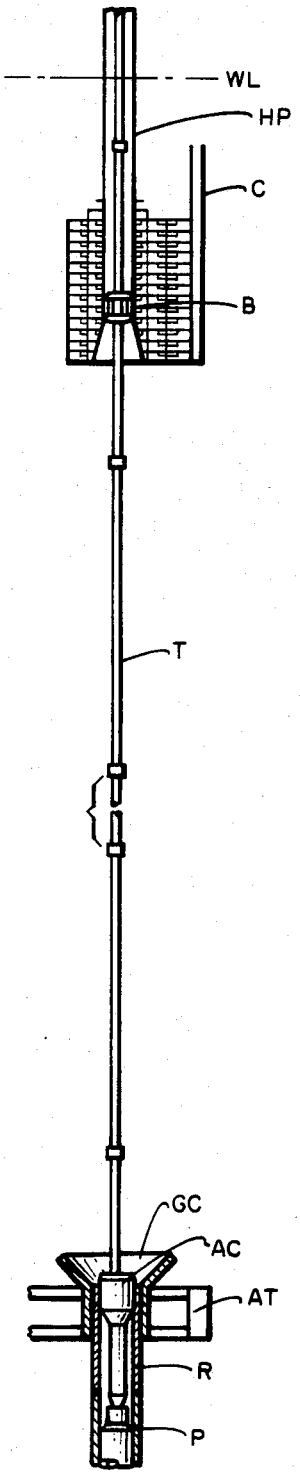
Fig. 1. PRIOR ART
FIG. 1, as above mentioned, illustrates the prior art system showing the string of tendon segments attached at its bottom end in a template and at its upper end attached to the column with the top of the tendon string above the waterline.
Figure 2:
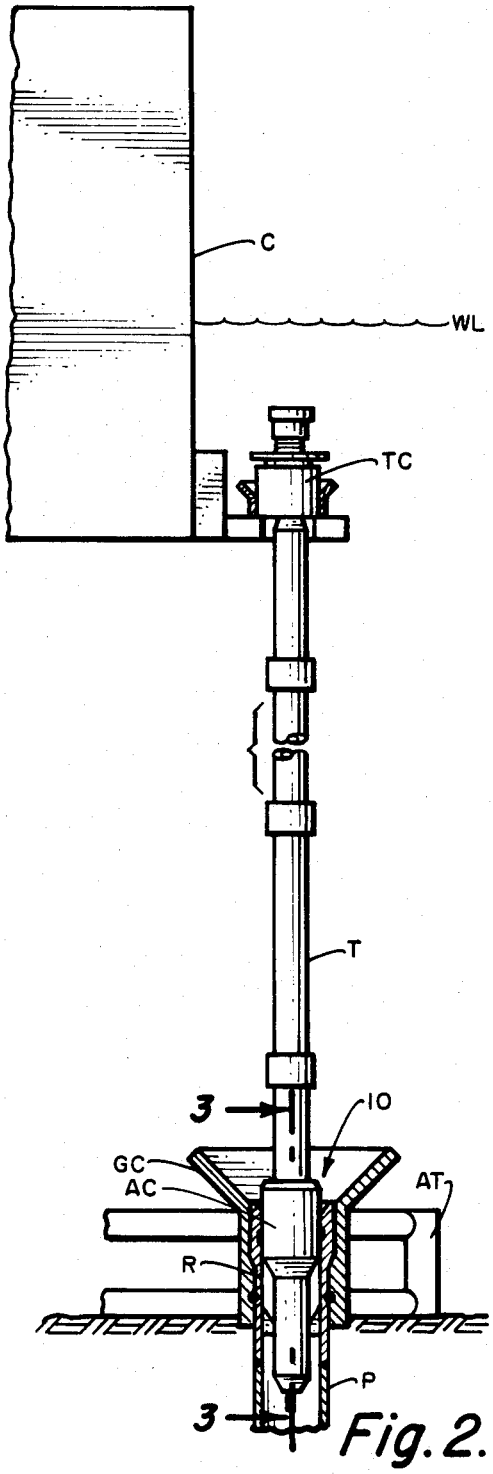
FIG. 2 is an elevational view of the above-mentioned second type of tendon system connected at the bottom end in a template and at the upper end, outside the tension leg platform, and below the waterline.

In the drawings, FIG. 1 was described in the Background of the Invention to show the type of tension leg platform where the tension legs are connected to the platform column. FIG. 2, on the other hand, shows the second type of tension leg platform, mentioned in the Background of the Invention, where the tendon system is suspended outside the tension leg platform and below the waterline. In this latter figure, the tendon is connected at its upper end to an extension from the column C by a top connector TC, usually with an integral flexible joint. This top connector TC does not form a part of this invention except insofar as it connects the tension leg to the platform.

Also in FIG. 2, the lower or bottom end of the tension leg there is shown an anchor template AT connected to the pile, and receptacle R within a guide cone GC to guide and latch the bottom or anchor connector of this invention which is indicated in its entirety as 10. As previously described, the purpose of this bottom connector 10 is to connect the tension leg to the receptacle.

Figure 3:
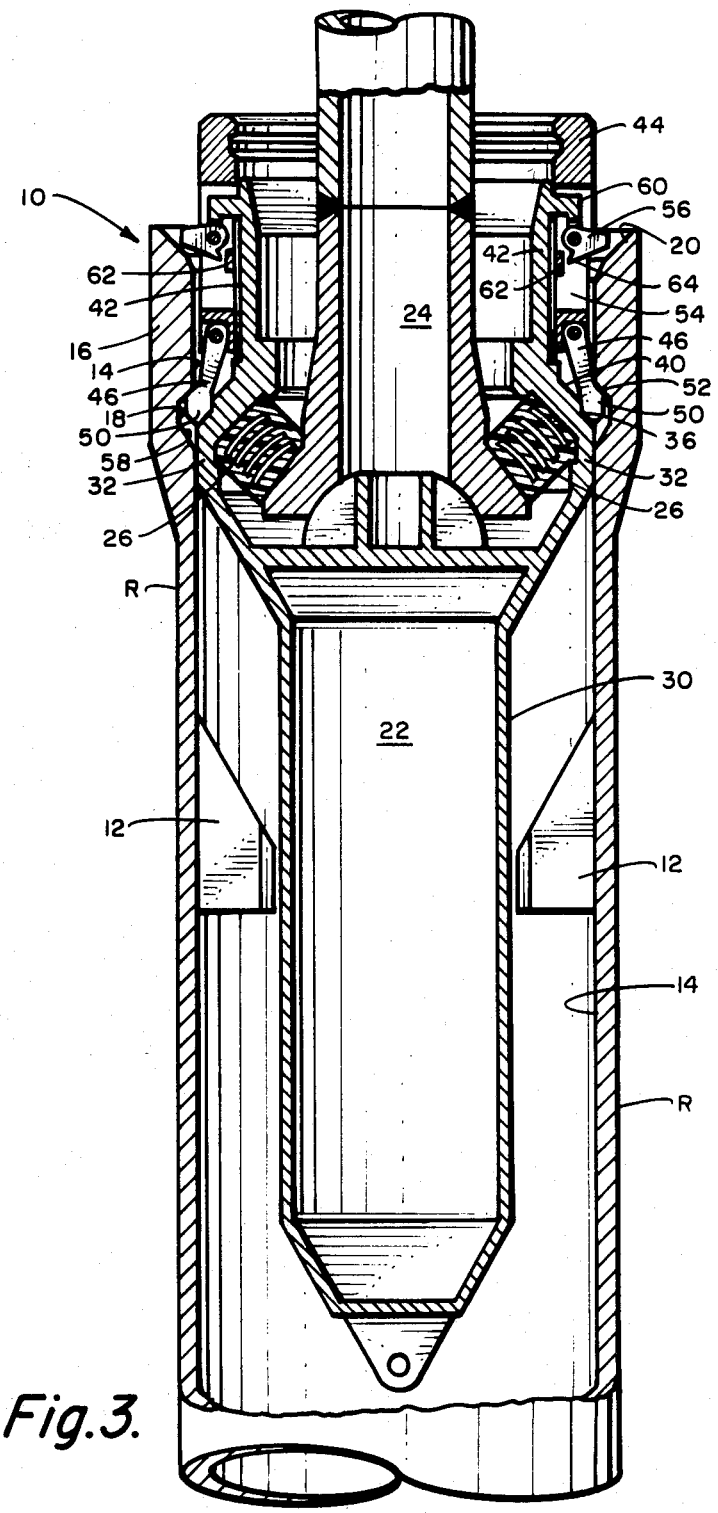
FIG. 3 is an enlarged cross-sectional view, taken along line 3—3 of FIG. 2, of the non-rotational type tendon bottom connector of this invention.

Turning now to FIG. 3, which is an enlarged cross-sectional view of the bottom connector 10 and receptacle R shown in FIG. 2 in elevation and partly broken away to show the details thereof.

The receptacle R is shown to be a hollow cylinder with cone type guide fins 12 on its inner wall 14, and which terminates at its upper end with a thickened upper wall portion 16 having an internal latch recess 18 and cone shaped upper guide surface 20. The recess is also sometimes called a "profile."

The bottom connector 10 comprises a first or lower body member 22, sometimes referred to as a "fixed" body member since it is prevented from swiveling when inserted in the receptacle, and a second or upper body member 24 connectable to the tendons, and separated by a flexible element 26 to permit rotational movement between the upper body member 24 and the lower body member 22. This arrangement is also referred to as a flexible joint or a flex joint and also connects the upper and lower body together and permits the upper body member 24 to move due to movement induced in the tendons by the platform. This bending movement has also sometimes been referred to as "universally pivotal movement."

The lower end of the lower body member 22 is essentially bullet shaped in configuration as at 30 to cooperate with the receptacle bore 14 and the guide fins 12 to provide a desirable installation angle, and tapers inwardly and outwardly so that its mid-body portion 32 has an outer diameter only slightly less than the inner wall 14 of the receptacle R to permit the lower body member 22 to move relative thereto. Above the mid-body portion 32 of the body member 22 tapers inwardly to form a first ledge 36, and a second, upper, ledge 40. Above the ledge 40, the body member 22 is provided with a cylindrical guide sleeve 42 having an outer diameter less than the inner diameter of the receptacle inner wall 14 to form a space between the inner wall 14 of the receptacle R to receive a cylindrical latch carrier 44 on the guide sleeve 42 in slidable telescoping relationship therewith. The width of the carrier 44 is such that its bottom end is above the ledge 40 and extends upwardly beyond the upper end of the guide sleeve 42.

The carrier 44 has a plurality of latch segments or dogs 46 having dogheads 50, pivotally connected to the carrier, which extend downwardly so that, in the latched position shown, the dogheads are in contact with the lower ledge 36 and with an upper ledge 52 of the recess 18. In this position, the bottom connector 10 is considered latched in the receptacle R. It should be noted that the lower body member is shown in one piece for the purpose of this description but would actually be fabricated in several pieces to facilitate assembly.

The carrier is provided with a plurality of vertical slots (windows) 54 through which a plurality of keys 56 extend. (Only two keys are shown for simplification of the disclosure.) Keys 56 are pivotally connected on extensions 60 on the lower body member and are spring biased to assume a horizontal position. The bias may be obtained in any suitable manner such as by elastomeric or coil springs. Also midway of the recesses and forming part of the carrier is a locking ring 62, which cooperates with spurs 64 on the keys 56. The function of the keys 56, spurs 64, and lock ring 62 in the release of the bottom connector will now be explained. It should be noted first, however, that the mid-portion 32 fits within the inner diameter of the receptacle in sliding relationship but only the dogs 50 and the keys are capable of extending radially outwardly a distance beyond the outer diameter of this mid-portion.

FIGS. 4*a–d* illustrate the tendon bottom connector 10 installation in the receptacle.

Figure 4A:
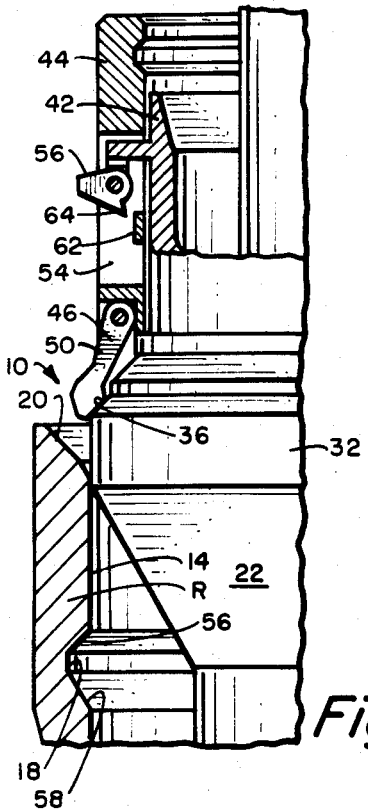
FIGS. 4*a–d* illustrate the bottom connector latch installation.

In FIG. 4*a* the latch segments 46 are shown resting on the ledge 36 of the lower body member 22. The dogheads 50 extend radially outwardly of the inner wall 14 of the receptacle R as the bottom connector 10 is guided into the receptacle R. This is the position assumed by the latch segments and carrier due to the force of gravity.

Figure 4B:
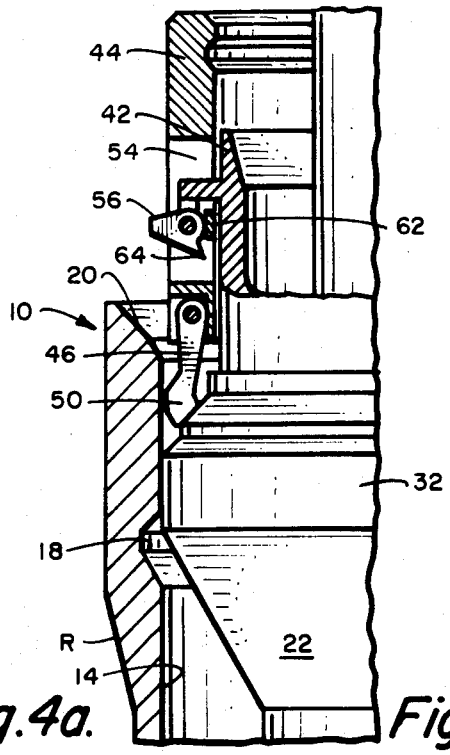

FIG. 4*b* shows the dogheads 50 within the receptacle after having been moved upwardly and radially inwardly by the guide surface 20 which, in turn, moved the latch segments and the carrier 44 upwardly relative to the lower body member by the reaction of the dogheads 50 against the guide surface 20. In this position, the ring 62 on the carrier 44 is located behind the keys 56 on the carrier.

Figure 4C:
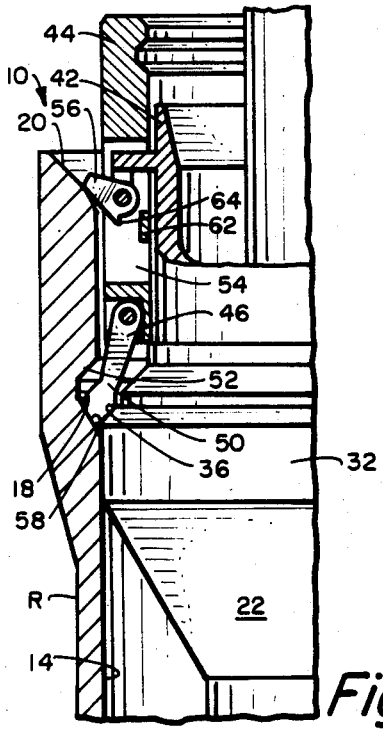

FIG. 4*c* illustrates the dogheads 50 located within the receptacle recess 18 and resting against ledge 36 on the lower body member 22 and initially latching the connector 10 to the receptacle R. In this position, the keys 56 are resting on the guide surface 20 of the receptacle R. Again the carrier 44 and latch segments have lowered relative to the lower body member to the same position as the FIG. 4*a*.

Figure 4D:
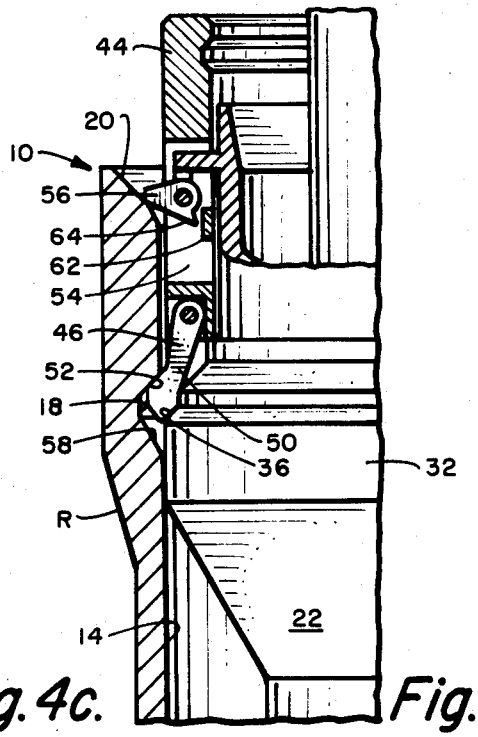

FIG. 4*d* illustrates the tendon leg having been placed in tension with the dogheads 50 engaging the upper edge 52 of the recess 18 and the ledge 36 of the lower member. In this position, the keys 56 are still engaging on the guide surface 20 of the receptacle. This figure also shows the bottom connector latched to the receptacle as also shown in FIG. 3.

The connector 10 can be lowered at any time further into the receptacle so long as the keys 56 do not reach the receptacle recess 18 as will be apparent from the following description of FIGS. 5*a–f*, and unless the keys do engage the recess 18, the latching mechanism will reengage automatically when tension is again applied. Lowering the bottom connector will cause the dogs to first engage the lower edge 58 of the recess 18 to urge the carrier upwardly and thus allow the dogheads to move axially inside the receptacle R.

FIGS. 5*a–f* illustrate the release of the bottom connector 10 without the use of tools, manual or ROV intervention, etc.

Figure 5A:
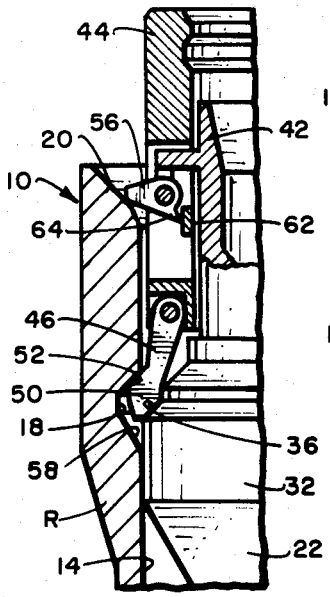
FIGS. 5*a–f* illustrate the bottom connector release.

FIG. 5*a* corresponds with FIG. 4*d* in showing the bottom connector 10 latched in the receptacle R.

Figure 5B:
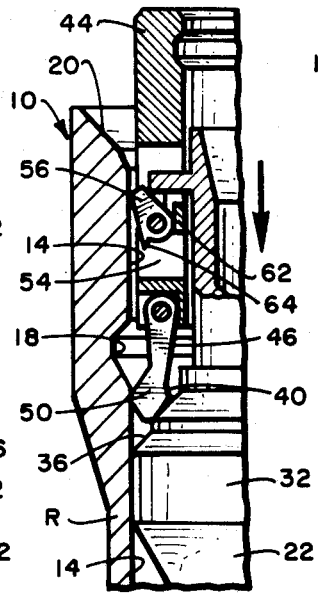

FIG. 5*b* illustrates the initiation of the release of the bottom connector. In this figure, the lower body member 22 and carrier 44 have moved downwardly in the receptacle so that the dogheads 50 are allowed to move inwardly out of the receptacle recess 18 and rest against the ledge 40 of the lower body member 22. As shown, the keys 56 have also moved within the inner wall 14 of the receptacle after having engaged the recess edge 58 and moved the carrier upwardly.

Figure 5C:
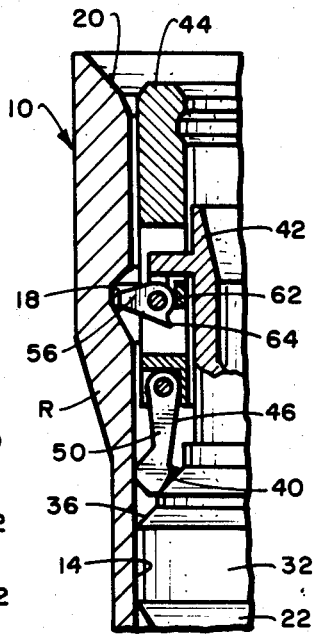

FIG. 5*c* illustrates the further downward movement of the lower body member 22 and carrier 44 with the dogheads resting against the side wall of the receptacle and against the ledge 40 while the keys 56 have now entered the recess 18 and assumed a horizontal position due to their spring bias. The position of the carrier 44 relative to the guide sleeve 42 is the same, or substantially the same, as in FIG. 5*b*.

Figure 5D:
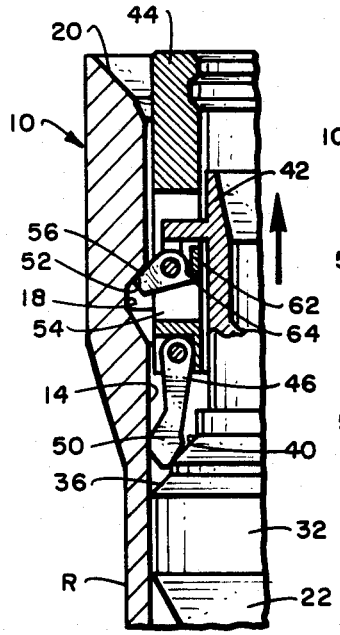

FIG. 5*d* shows the beginning of the upward movement of the lower body member 22 and the carrier 44. The keys 56, reacting against the top edge 52 of the recess 18, pivot, thus urging the spurs 64 against the carrier ring 62 and beginning to urge the ring 62 and carrier 44 upwardly, thus allowing the dogheads 50 to remain within the receptacle wall 14. The position of the carrier 44 relative to the guide sleeve 42 is the same, or substantially the same, as in FIGS. 5*b* and 5*c*.

Figure 5E:
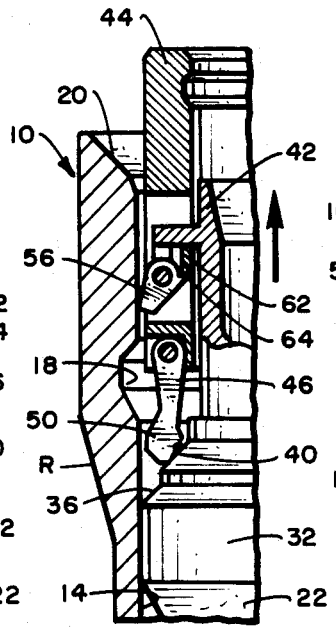

FIG. 5*e* illustrates the keys 56 now engaging the side wall on the top side of the recess 18, i.e., almost vertical, and the dogheads 50 free of the recess 18.

Figure 5F:
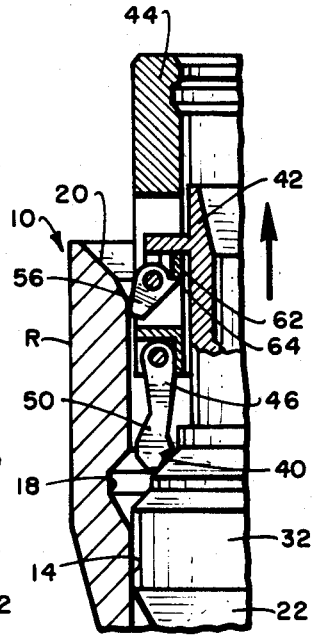

FIG. 5*f* shows the continued movement of the lower body member 22 and carrier 44 with sufficient room for the dogheads 50 to remain outside of the recess 18 and thus allow the bottom connector to be entirely released from the receptacle R. Further upward movement will release the keys 56 from the position shown in this Figure to assume their horizontal position as in FIGS. 4*a–d* and 5*a*, so that the bottom connector can again be automatically connected in the receptacle when desired.

From the foregoing, it is apparent that, the keys 56 and ring 62, as part of the release mechanism, perform the function of forcing and/or maintaining the carrier upwardly relative to the guide sleeve 42 to allow enough room for the latch segments to retract. A similar functioning mechanism will now be described in connection with FIGS. 6, 7, and 8.

Figure 6:
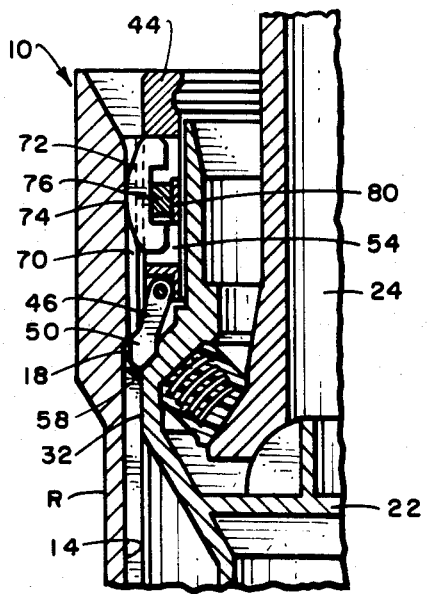
FIG. 6 is a partial cross-sectional view of part of a rotational type tendon bottom connector showing a resiliently actuated anti-rotation key for the carrier.

In FIG. 6, 7, 7*a* and 8, those parts of the bottom connector performing substantially the same function as in FIGS. 1–5, are given the same reference numerals to shorten the description herein. In these Figures, however, the receptacle R is provided with a plurality of longitudinal grooves 70 on the inner wall 14. The carriers 44, instead of carrying the keys 56, are provided with a plurality of radially biased anti-rotation keys 72 which are positioned in windows 54 to move upwardly and downwardly (axially) in the receptacle grooves 70. One such anti-rotation key is shown in FIG. 6 and shown with a curved outer surface 74 engaging the groove 70 and is biased radially by an elastomeric spring 76 between the key 72 and an inner ring 80 carried by the sleeve 44. The advantage of the elastomeric spring is that it allows the connector 10 to be stabbed into the receptacle and then upon rotation of the connector 10 the key 72 will snap out into the groove 70. As is apparent, the remainder of the bottom connector 10 is the same and is shown in the latched position as in FIG. 3.

Figure 7:
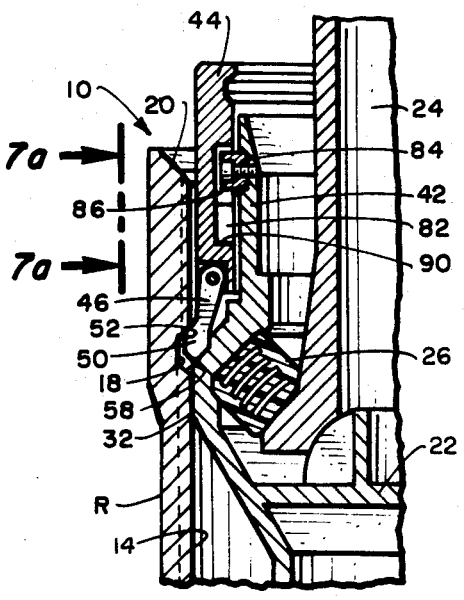
FIG. 7 is an enlarged cross-sectional view of part of the bottom connector, rotated peripherally from the cross-section of FIG. 6, illustrating the embodiment of FIG. 5 illustrating the rotational means (J slot/key) for releasing the bottom connector.
Figure 7A:
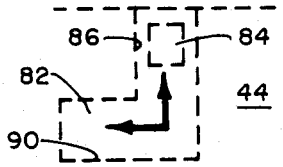
FIG. 7*a* is a schematic illustration of the movement of the relative movement of the J-slot key of FIG. 7, FIG. 8, like FIG. 5, illustrates another embodiment of the anti-rotation key for the rotational type bottom connector.

FIGS. 7 and 7*a* also show the bottom connector 10 in its latched position and another modification to the carrier 44. The carrier 44 is provided with a J-slot 82 which cooperates with a radial J-slot key 84 fixed to the guide sleeve 42 in any suitable manner as by bolts.

It is understood that a plurality of the anti-rotation keys 72 and the J-slot/J-slot key combinations 82, 84 are located alternately (interdigitized) about the periphery of the carrier 44 and guide sleeve 22. It is also to be understood that the J-slot 82 and J-slot key 84 would perform equally as well if they were reversed. That is to say, the J-slots would be in the guide sleeve 42 and the keys would be attached to the carrier 44.

To latch the bottom connector 10 in the receptacle R, the operation of the carrier 44 and guide sleeve 42 is similar to that previously described except that the bottom connector 10 will be rotated until the radial keys 72 engage the receptacle grooves 70. The carrier 44 will be in the position shown in FIG. 6 due to the force of gravity. The orientation of the radial keys 72 on grooves 70 will also position the J-slot/J-slot key combination 82, 84 such that the key 84 will be positioned in the opening or throat 86 to the J-slot 82.

So long as the carrier 44 is in the position shown, the bottom connector is free to move downwardly in the receptacle. The downward movement will cause the dogheads to engage the lower edge 58 of the recess 18 to move the carrier 42 upwardly to allow the dogheads 50 to slide freely on the inside of the receptacle. However, since the carrier 44 is under the influence of gravity, upward movement of the bottom connector will cause the latch segments to reengage the recess 18 to again automatically latch the bottom connector. During this upward and downward movement of the carrier, the J-slot key 84 moves upwardly and downwardly in the throat 86 of the J-slot 82. However, when the release of the bottom connector from the receptacle is desired, the bottom connector is again moved downwardly until the J-slot key 84 bottoms in the J-slot 82, the bottom connector then is rotated to move the key 84 in the lower area 90 or J of the J-slot 82 thus locking the carrier in an upward position. At this time the anti-rotation keys 72 prevent rotation of the carrier 42. Thus, upon retraction of the bottom connector, the latch segments are then free to move past the recess 18 without engaging into it, as described in connection with FIGS. 5*d–f*, supra.

Figure 8:
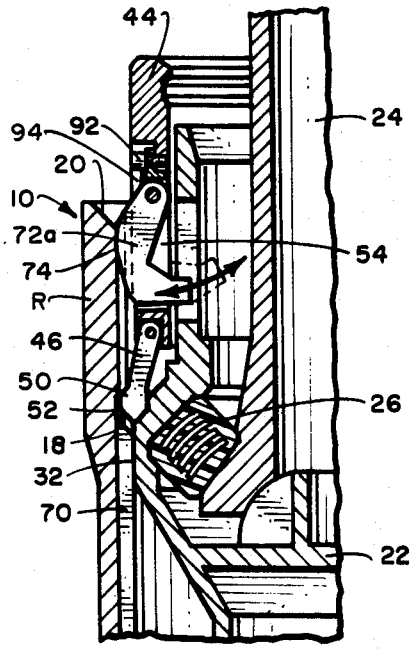

FIG. 8 illustrates an alternative embodiment of the anti-rotation key 72 of FIG. 6. In this Figure, the anti-rotation key 72*a* is pivotally connected to the carrier 44 so as to be free to move radially inwardly and outwardly upon engagement in the receptacle slot 70 and is biased outwardly by gravity or a coil or elastomeric spring (not shown) which is connected at one end to the carrier 44 by a set screw 92 and at the other end to the key 72*a*. The connection of the coil spring in this manner is conventional and need not be further described. Also, the guide sleeve is apertured as at 94 to accommodate the anti-rotation key 72*a*.

The operation of the embodiment of FIG. 8 is similar to that of FIGS. 6, 7, and 7*a*, it being understood that the embodiment of FIG. 8 will also include the J-slot/J-slot key combination 82, 84 of FIGS. 7 and 7*a*.

It is also understood that, in either of the latter embodiments, when the bottom connector 10 is removed entirely from the receptacle, the latching/release mechanisms can be reset to allow latching upon reentry into the receptacle, if desired.

Figure 9:
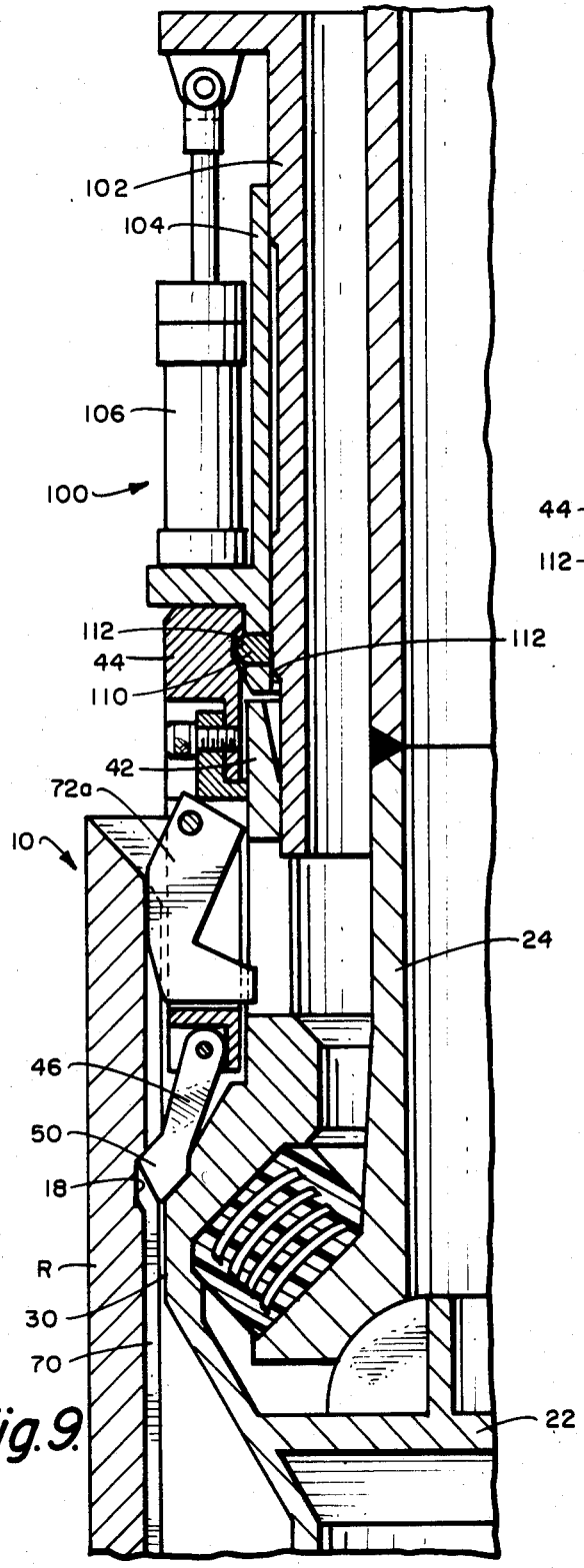
FIG. 9 is a cross-sectional elevational view of a hydraulic release tool (redundant means for release)
Figure 10:
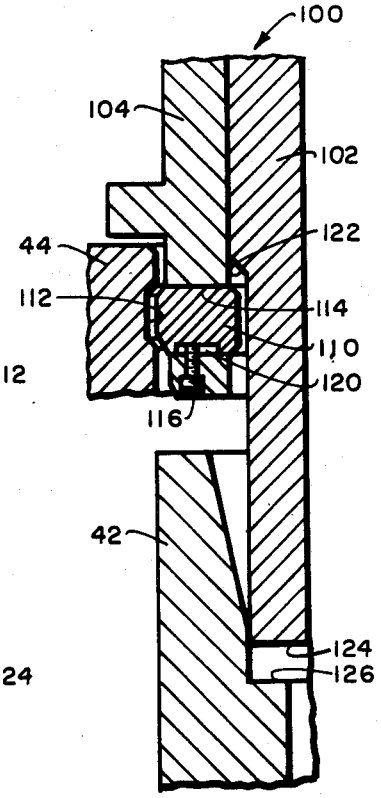
FIG. 10 shows part of the tool in position immediately before its operation to position the carrier so as to enable release of the bottom connector.

Turning now to FIGS. 9 and 10, there is shown a redundant (secondary) means by which the bottom connector 10 may be released if the primary release mechanism is not used for whatever reason.

As shown, this redundant means comprises tool 100 with an inner sleeve 102 and an outer sleeve 104 telescopingly slidable on the inner sleeve 100 and actuated by a hydraulic actuator 106 connected between the inner sleeve 102 and the outer sleeve 104. The inner sleeve 102 has a plurality of radially outwardly movable dogs 110 to engage a latching recess or profile 112 on the inner bore of the carrier 44. Each dog 110 is positioned in an opening 114 and held by a set screw 116 which projects into a radially oriented elongated slot 120. Radial outward movement of the dog is accomplished by downward movement of the inner sleeve 102 to a position where the ramp or shoulder 122 passes behind the inner edge of the dog and the thicker portion of the inner sleeve is located as shown in FIG. 9. While only one hydraulic actuator 106 is shown, a plurality (preferably four) of such actuators will be located about the periphery of the outer sleeve 104 for force balance. The inner sleeve 102 will be hinged and buckled in a conventional manner to permit the tool to be clamped around the outer periphery of the tendon segment. It is to be understood and will be apparent to those skilled in the art that the hydraulic actuator may be replaced with a spring type actuator.

In operation, the tool is lowered until the dogs are opposite the latching recess 112. At this time the actuator 106 is partially retracted. Further retraction of the activator will cause the lower end 124 of the inner sleeve to engage a ledge 126 on the guide sleeve 42. In this position, the actuator 106 is situated to move the outer sleeve upwardly to pull the carrier 44 upwardly allowing the withdrawal of latching segments 46. As can be seen, the purpose of this tool is to accomplish hydraulically what was accomplished by the keys 56 and the J slot/J-slot key combination 82, 84, i.e., to position the carrier 44 at its upward position to allow the latch segments to have sufficient radially inward movement so that the dogheads will not automatically engage the latching recess 10 in the receptacle R.

I claim:

1. A bottom connector for connecting a tendon segment of a tension leg platform to a subsea template which includes a receptacle for said connector comprising a first body member adapted to be received within an anchor receptacle, a second body member connected to the first body member through a flexible joint for universally pivotal movement and adapted to be connected to the tendon segment, a latch carrier movable with respect to said first body member and having latch segments pivotally connected to said latch carrier, said latch segments being such that in one position of said latch carrier, said latch segments engage both a recess in the receptacle and the firstbody member when the connector is inserted into said receptacle a sufficient distance so that said latch segments and carrier will react to said recess and such that when the latch carrier is in another position, the latch segments are clear of said recess to enable said connector to move further into said receptacle or to allow said bottom connector to be removed from said receptacle, and release means operative to maintain said carrier in said other position if a decision is made to remove said connector from said receptacle.

2. The connector as claimed in claim 1 wherein said release means reacts to said recess.

3. The connector as claimed in claim 2 wherein said release means reacts to said recess when said connector is inserted further into said receptacle from said engaged position.

4. The connector as claimed in claim 2 wherein said release means is positioned on said carrier and first body member.

5. The connector as claimed in claim 4 wherein said release means comprise key means.

6. The connector as claimed in claim 1 wherein said release means is responsive to rotational movement of part of said connector.

7. The connector as claimed in claim 6 wherein said release means is a J-slot/J-slot key combination.

8. The connector as claimed in claim 7 wherein said J-slot/J-slot key combination is located and operative between said carrier and said first body member.

9. The connector as claimed in claim 8 wherein said carrier includes anti-rotation means preventing rotation of said carrier relative to said receptacle so that said rotation of said connector will operate said combination.

10. The connector as claimed in claim 9 wherein said anti-rotation means comprises a key which engages a slot in said receptacle when said connector is inserted and/or rotated in said receptacle.

11. The connector as claimed in claim 10 wherein said key is spring biased outwardly of said carrier.

12. The connector as claimed in claim 10 wherein said key is oriented outwardly of said carrier by gravity.

13. The connector as claimed in claim 1 wherein said release means comprises means to engage said carrier, move and maintain said carrier in said other position.

14. The connector as claimed in claim 1 wherein part of said first body member is of a reduced outer diameter relative to the carrier and remainder of said first body member to guide said connector into said receptacle and to react against guide fins located in said receptacle.

15. A bottom connector for connecting a tendon segment of a tension leg platform to a subsea template having a vertically mounted receptacle comprising, a first body member and having an outer diameter on a portion thereof which is such that said outer portion will slidingly engage the inner wall of said receptacle when said first body member is inserted into the receptacle, a second body member connected to the first body member through a flexible joint for universal pivotal movement and adapted to be connected to the tendon segment, a latch carrier on said first body member and free to move vertically between a first position and second position with respect to said first body member and having latch segments pivotally connected thereon, a doghead at the end of each latch segment, said latch segments being such that in the first position of said latch carrier, said dogheads extend outwardly beyond the outer diameter of said first body member to first engage said inner wall thereby moving said latch carrier to its second position and to automatically engage both a recess in the receptacle and said first body member when the bottom connector is further inserted into said receptacle and such that when the latch carrier is moved toward the second position by reaction of said dogheads within said recess and upon further movement of said connector within said receptacle or by other means, said dogheads are clear of said recess, and means operative to maintain said carrier in its second position to prevent said dogheads from reacting to said recess so that said connector may be removed from said receptacle.

16. The connector as claimed in claim 15 wherein said last mentioned means reacts to said recess.

17. The connector as claimed in claim 16 wherein said last mentioned means comprises pivotally mounted keys.

18. The connector as claimed in claim 15 wherein said last mentioned means is a J-slot/J-slot key combination operative between said first body member and said carrier.

19. A tool for releasing a bottom connector of a tension leg platform from a subsea receptacle, said bottom connector having latch means for connecting said connector to said receptacle and means for connecting said connector to a tendon segment of said tension leg platform, said latch means on a carrier in said bottom connector being actuatable by first a downward movement of said bottom connector and then by upward tension applied to said tendon segment, said latch means being releasable from said receptacle by further downward movement of said bottom connector and by an upward movement of said carrier relative to the remainder of said bottom connector, and engagement means on said tool to engage said carrier and pull said carrier upwardly relative to the remainder of said connector thereby rendering said latch means inoperative to connect said bottom connector to said receptacle.

20. The tool as claimed in claim 19 wherein said engagement means comprises radially movable dogs which are receivable in a recess in said carrier.

21. The tool as claimed in claim 20 further including a sleeve which engages said bottom connector and which moves said dogs radially outwardly.

22. The tool as claimed in claim 21 wherein said dogs are moved upwardly while said sleeve remains stationary thereby moving said carrier upwardly.

23. The tool as claimed in claim 22 wherein said tool includes hydraulically responsive means to move said dogs.

* * * * *